US005472006A

United States Patent [19]

Kuo et al.

[11] Patent Number: 5,472,006

[45] Date of Patent: Dec. 5, 1995

[54] STRUCTURE FOUR-SECTION UMBRELLA FRAMEWORK WITH ATTACHABLE FLEXIBLE FRAME MEMBER

[76] Inventors: Cheng M. L. Kuo, No. 18, Alley 15, Lane 582, Sea Ta Road, Hsinchu; Shen H. Wang, No. 75, Ann Mei Road, Kon Kaung Village, Ho Li, Taichung, both of Taiwan

[21] Appl. No.: 214,492

[22] Filed: Mar. 18, 1994

[51] Int. Cl.[6] ..... A45B 19/00

[52] U.S. Cl. ..... 135/31; 135/32; 135/37; 135/42; 135/28; 135/29; 135/25.3

[58] Field of Search ..... 135/31, 32, 37, 135/42, 28, 29, 25.3, 25.31, 25.33, 25.34

[56] References Cited

U.S. PATENT DOCUMENTS

| | | | |
|---|---|---|---|
| 38,325 | 4/1863 | Newhall | 135/31 |
| 777,999 | 12/1904 | Baldwin | 135/31 |
| 1,109,736 | 9/1914 | Cartwright | 135/25.31 |
| 4,627,455 | 12/1986 | Okuda et al. | 135/31 X |
| 5,063,953 | 11/1991 | Wu | 135/31 X |
| 5,135,016 | 8/1992 | Stiller | 135/31 X |
| 5,193,565 | 3/1993 | Huang | 135/31 X |
| 5,235,998 | 8/1993 | Liu | 135/31 X |
| 5,297,572 | 3/1994 | Kuo | 135/31 X |
| 5,323,801 | 6/1994 | Kuo | 135/31 X |
| 5,337,770 | 8/1994 | Wang | 135/31 X |

*Primary Examiner*—Wynn E. Wood

*Attorney, Agent, or Firm*—Morton J. Rosenberg; David I. Klein

[57] ABSTRACT

An improved four-section umbrella framework is provided. The framework includes an attachable flexible frame member having a small slot in the main frame member of the umbrella framework. A connector is positioned inside the main frame member such that the latch ring of the connector protrudes through the small slot on the main frame member and provides for the simple attachment of a hook formed at the end of a flexible frame member to form a secure and practical hook joint.

1 Claim, 7 Drawing Sheets

STRUCTURE FOUR-SECTION UMBRELLA FRAMEWORK WITH ATTACHABLE FLEXIBLE FRAME MEMBER

BACKGROUND ON THE INVENTION

To facilitate storage, a conventional four-section umbrella framework can be collapsed inward from the tail frame member of the umbrella because of a flexible frame member attached to and in between the second main frame member and the inner end of the umbrella tail frame member. The inner end of the flexible frame member (5) is fastened to the second main frame member by a rivet (7), which also serves as a hinge pin, wherein the inner end of the flexible frame member (5) is of a circular structure connecting ring (52) placed around the rivet (7) which, when the umbrella is opened, also provides for the active rotation of flexible frame member (5), with a relatively large slot (25) in the end section of the second main frame member that accommodates the movement of the flexible frame member (5). Due to the placement of the relatively large slot (25) in this kind of conventional structure, it is not difficult to undermine the structural strength of the umbrella framework and, furthermore, it is necessary to insert a rivet (7) and include a hinge structure, which results in troublesome manufacturing procedures, wasted time and effort and higher production costs. Therefore, such conventional umbrella frameworks do not conform to principles of practicality.

In view of this, the main objective of the invention herein is to overcome the aforementioned disadvantages by utilizing an innovative and improved structure that enables umbrella frameworks to be constructed and assembled in an extremely simple manner while, furthermore, ensuring structural strength. The following attached drawings illustrate the structural characteristics and functions of the invention herein.

DETAILED DESCRIPTION OF THE INVENTION

Figure 5:
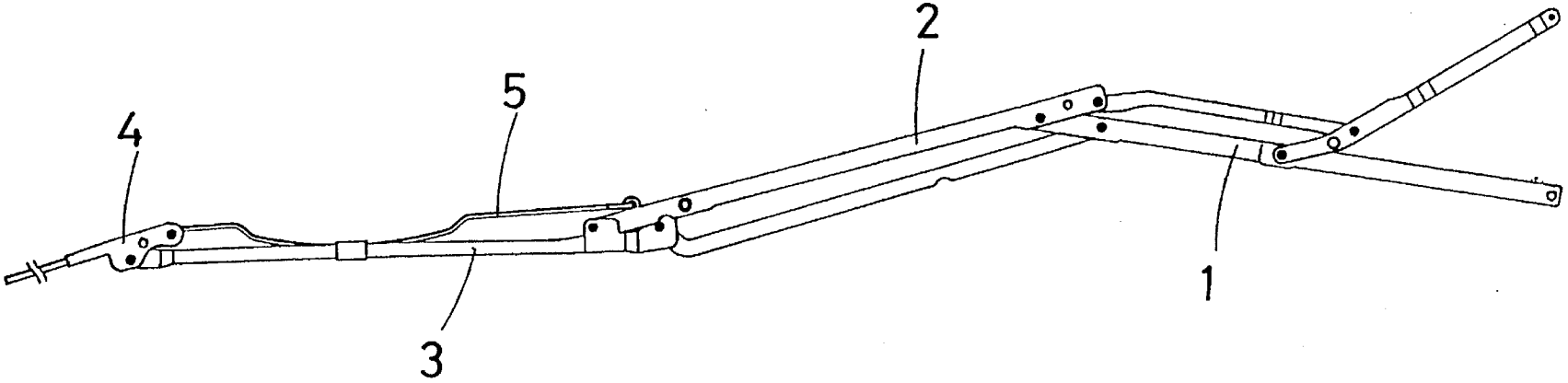
FIG. 5 is an orthographic drawing of the preferred embodiment of the invention herein when the umbrella is open.

As indicated in FIG. 5, the preferred embodiment of the invention herein includes a first main free member (1), a second main frame member (2). a third main frame member (3), an umbrella tail frame member (4) and a number of support members, of which the structure of the umbrella framework is generally similar to that of conventional umbrellas and thus will not be discussed further. The major innovations of the invention herein are the flexible frame member (5) and the improved hinge structure of the second main frame member (2), which eliminate the utilization of a rivet.

Figure 1:
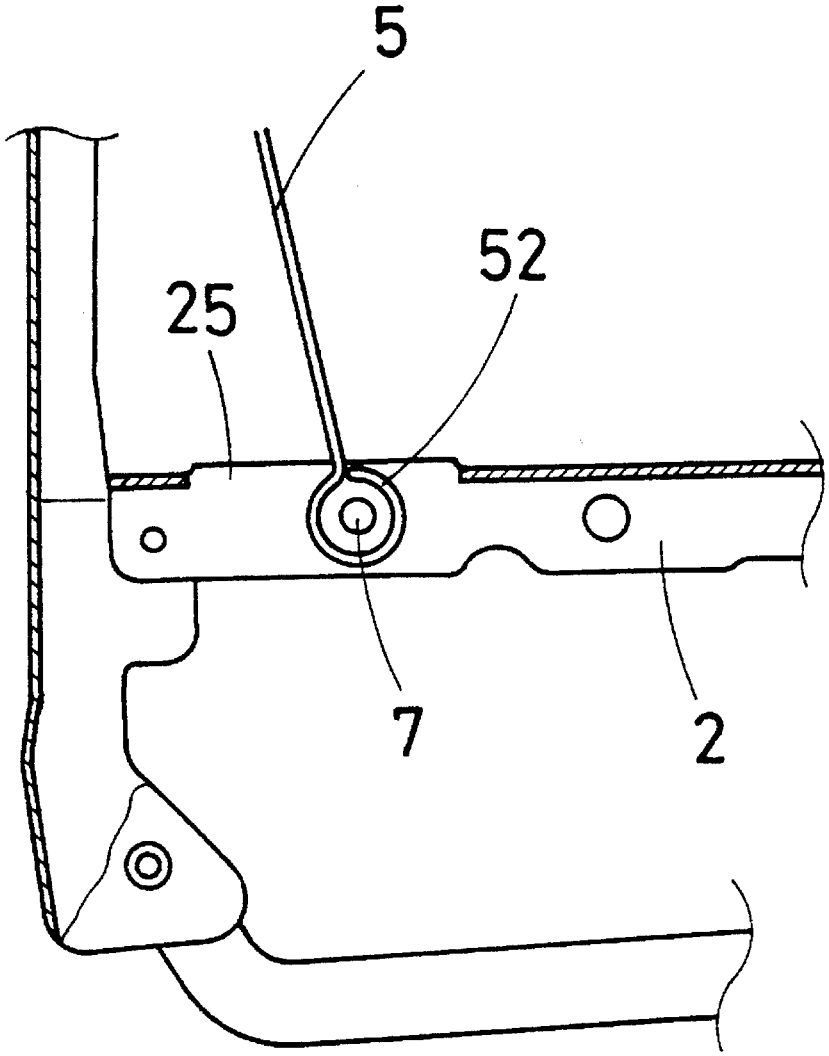
FIG. 1 (Prior art)
FIG. 1 is a cross-sectional drawing of the prior art.
Figure 2:
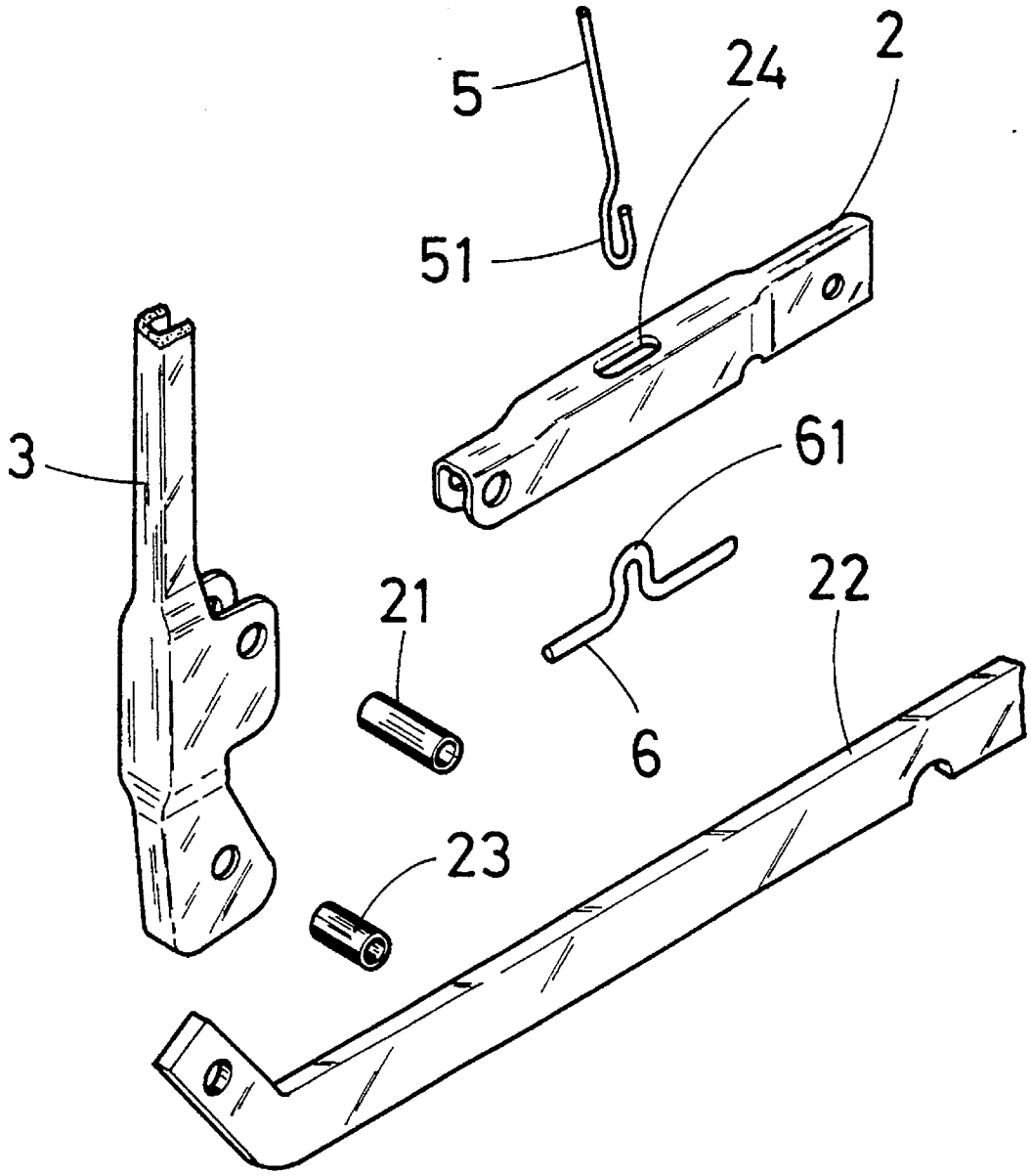
FIG. 2 is an exploded drawing of the invention herein.
Figure 3:
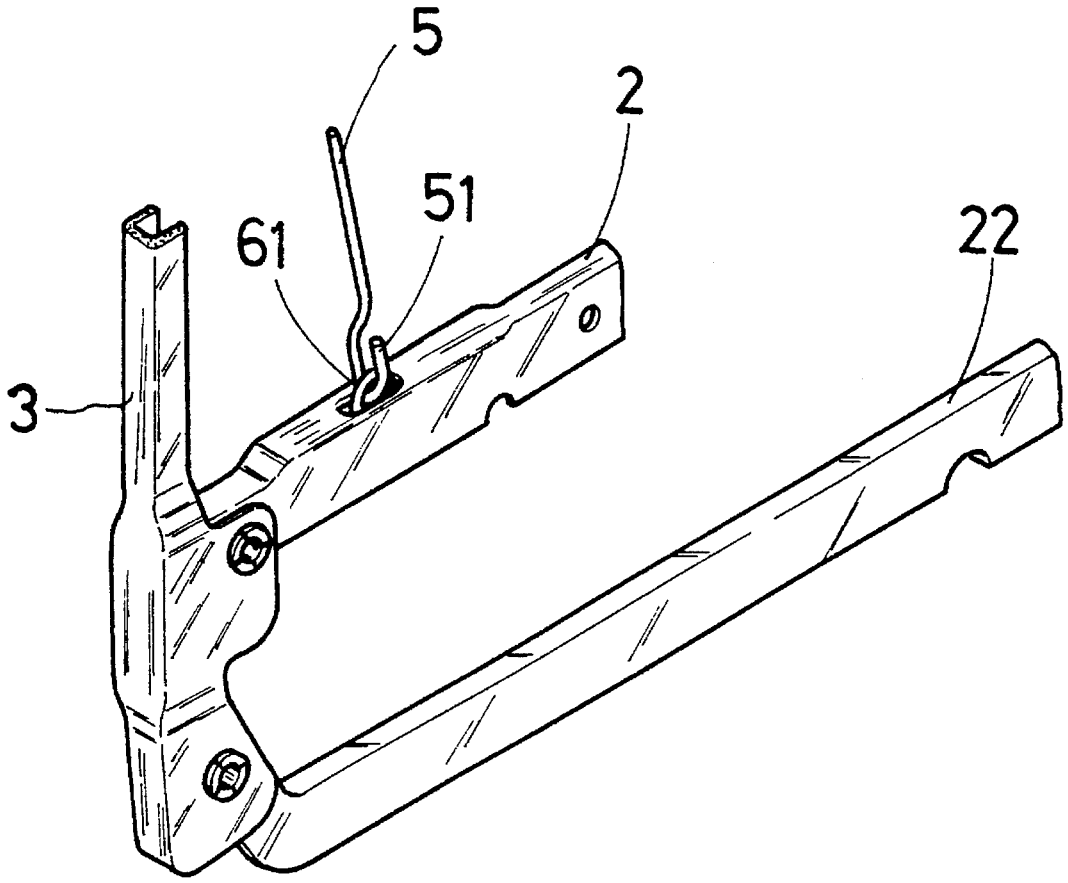
FIG. 3 is an isometric drawing of the assembled invention herein
Figure 4:
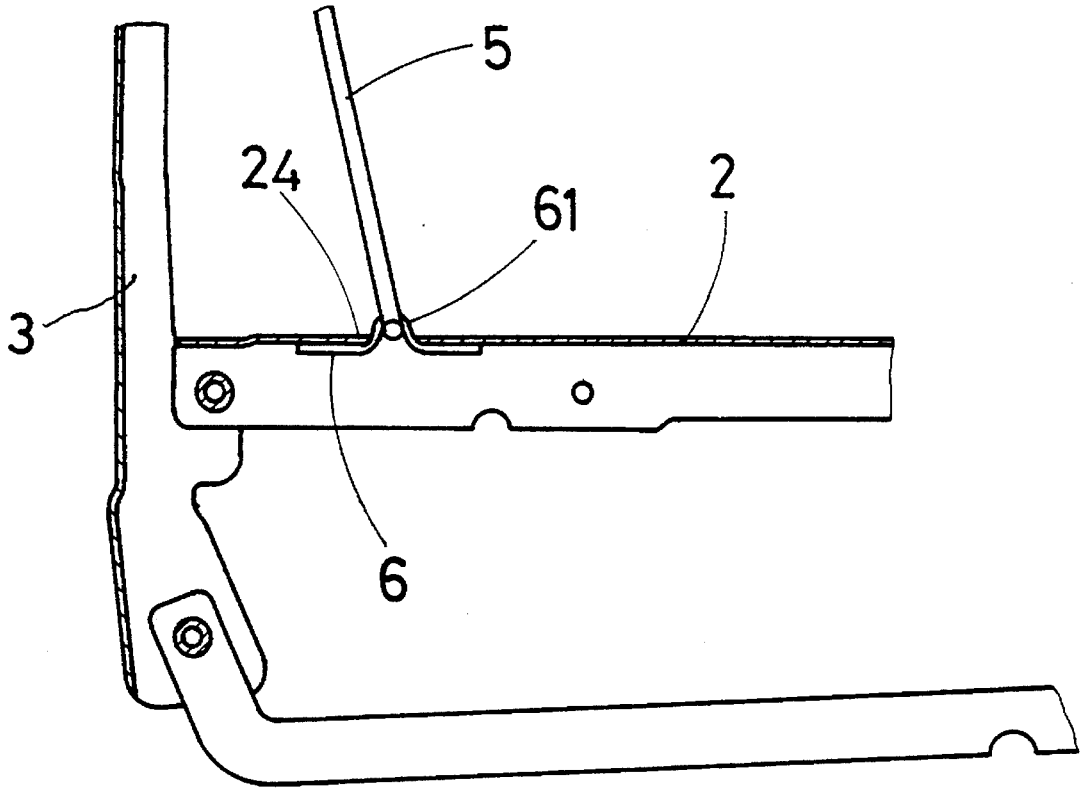
FIG. 4 is a cross-sectional drawing of the assembled invention herein.

As indicated in FIG. 2, FIG. 3 and FIG. 4 of the invention herein, the outer end of the second main frame member (2) is hinged to the third main frame member (3) by a pin (21) and the second support member (22) is hinged to the innermost end of the third main frame member (3) by another pin (23), wherein the innovative features of the invention herein are the placement of a short slot (24) through the outer section of the second main frame member (2) as well as the placement of a connector (6) within the interior of the second main frame member (2) and, furthermore, the connector (6) has a latch ring (61) that protrudes through the slot (24), thereby enabling the latch ring (61) to be pulled upwards inside the aforesaid slot through the second main frame member (2); the inner end of the flexible frame member (5) is shaped into a hook (51) that can be attached to the latch ring (61), thereby forming a hook joint.

Figure 6:
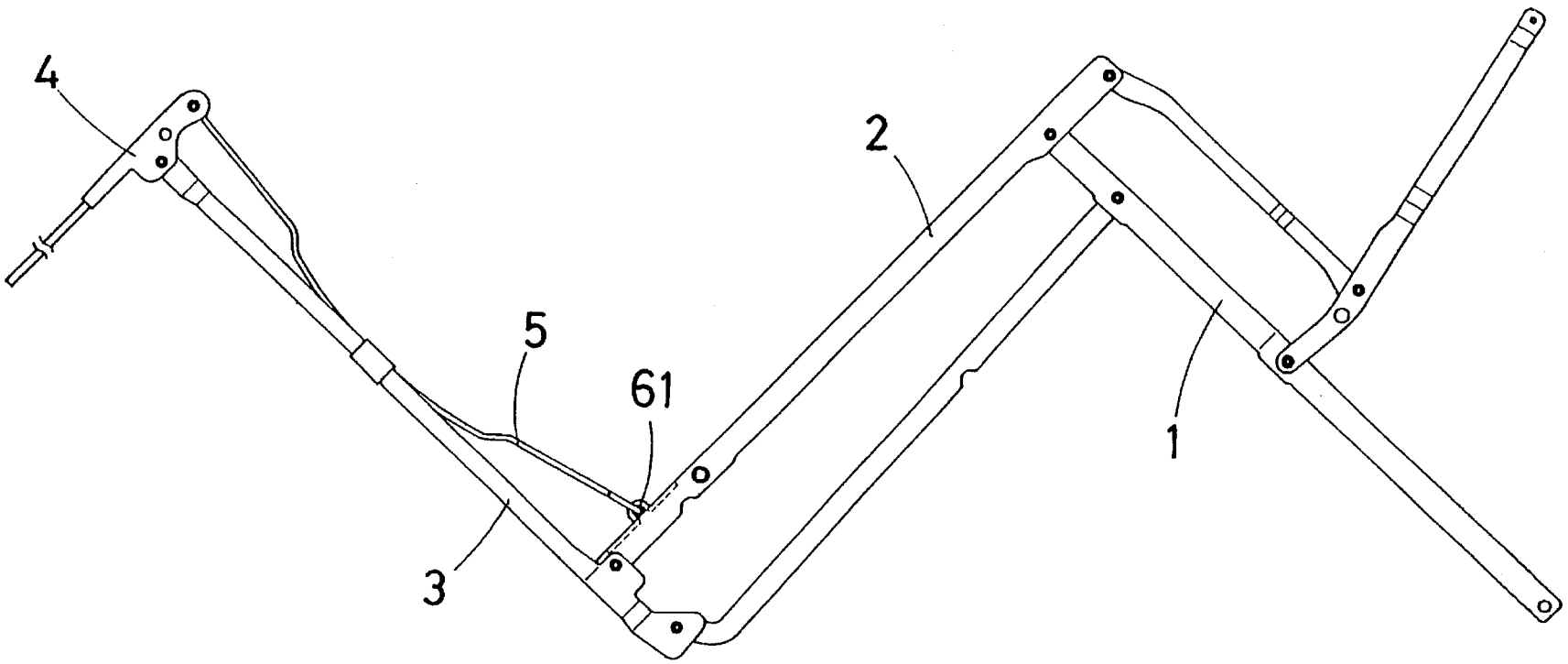
FIG. 6 is an orthographic drawing of the preferred embodiment of the invention herein when the umbrella is in a partially opened state.
Figure 7:
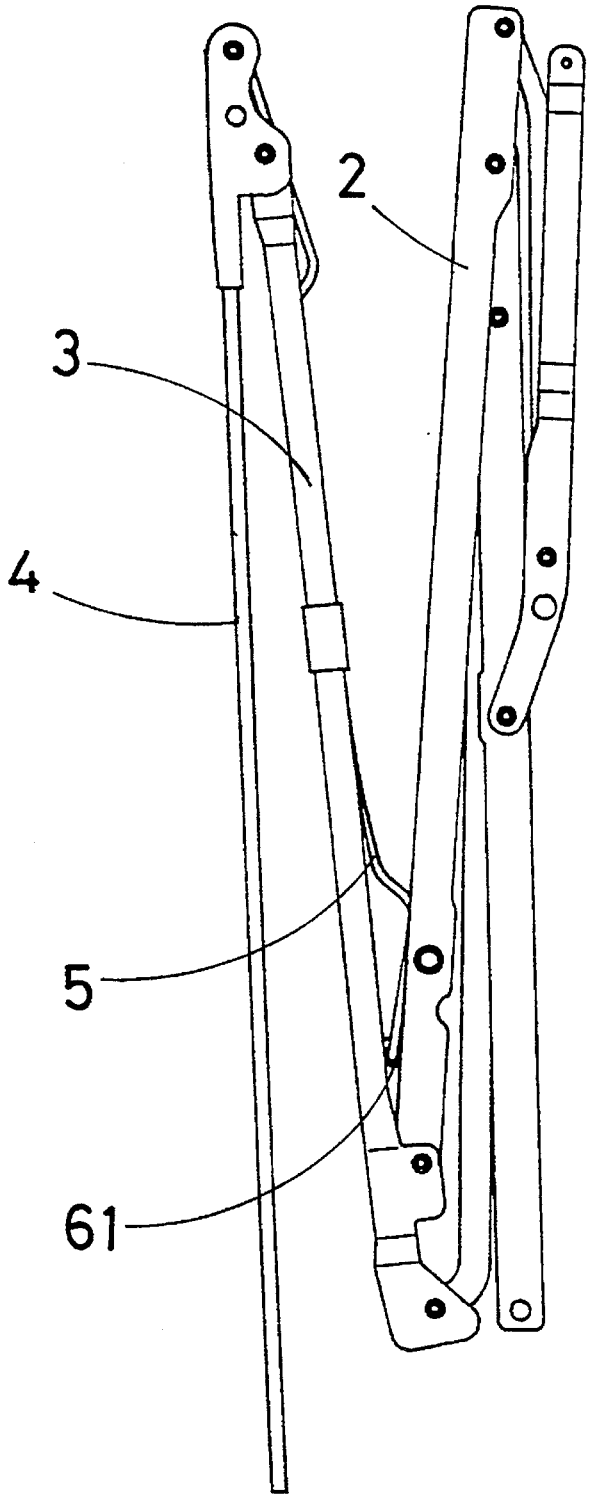
FIG. 7 is an orthographic drawing of the preferred embodiment of the invention herein when the umbrella is folded.

Since the flexible frame member (5) is designed to produce upward tensility, the flexible frame member (5) causes the connector (6) to remain secured to the interior of the second main frame member (2) in a protruding position through the slot (24), such that when the umbrella is opened, the connector (6) retains hinge functions, as indicated in FIG. 6 and FIG. 7.

Based on the foregoing description, it can be acknowledged that the structural assembly of the invention herein is of extreme practicality, wherein it is only necessary to perform the physical attachment into the main framework followed by the attachment of the flexible frame member, thus eliminating the inconvenient and troublesome installation of a rivet, while increasing the economic efficiency of the product; furthermore, since only a single small hole is required in the main frame members to enable the 180 degree rotation of the flexible frame member, the practicality of the invention herein far exceeds that of the prior art no matter how much the slot of a conventional umbrella framework is enlarged, and the minimum rotation angle of 180 degrees is the optimum for preventing the destruction of umbrella framework strength.

What is claimed is:

1. A four-section umbrella framework, comprising:

a first main frame member;

a second main frame member having a first end hingedly coupled to said first main frame member, said second main frame member having a channel formed longitudinally therein and a slotted opening formed through an upper surface of said second main frame member adjacent a second end thereof, said slotted opening being in open communication with said channel;

a third main frame member having a first end hingedly coupled to said second end of said second main frame member;

a tail frame member having one end hingedly coupled to a second end of said third main frame member;

a connector disposed within said channel of said second main frame member, said connector having a latch ring formed thereon and extending through said slotted opening; and, a flexible frame member having one end pivotally coupled to said tail frame member and an opposing end having a hook formed thereon for engagement with said latch ring, said hook end of said flexible frame member providing a tensile force to said latch ring.

* * * * *